US007733282B2

(12) United States Patent
Kharadly

(10) Patent No.: US 7,733,282 B2
(45) Date of Patent: Jun. 8, 2010

(54) REFLECTOR ANTENNA

(75) Inventor: Mostafa M. Kharadly, 1766 West 68th Ave., Vancouver, BC (CA) V6P 2W1

(73) Assignee: Mostafa M. Kharadly, Vancouver, B.C. (CA)

( * ) Notice: Subject to any disclaimer, the term of this patent is extended or adjusted under 35 U.S.C. 154(b) by 137 days.

(21) Appl. No.: 11/909,042

(22) PCT Filed: Mar. 16, 2006

(86) PCT No.: PCT/CA2006/000389

§ 371 (c)(1),
(2), (4) Date: Sep. 18, 2007

(87) PCT Pub. No.: WO2006/096979

PCT Pub. Date: Sep. 21, 2006

(65) Prior Publication Data

US 2008/0204342 A1 Aug. 28, 2008

Related U.S. Application Data

(60) Provisional application No. 60/662,822, filed on Mar. 18, 2005, provisional application No. 60/719,600, filed on Sep. 23, 2005.

(51) Int. Cl.
*H01Q 13/00* (2006.01)
*H01Q 3/12* (2006.01)

(52) U.S. Cl. ..... 343/781 R; 343/761

(58) Field of Classification Search ..... 343/779, 343/781 R, 757, 761, 763
See application file for complete search history.

(56) References Cited

U.S. PATENT DOCUMENTS

| | | | | |
|---|---|---|---|---|
| 3,534,373 | A | | 10/1970 | Gustincic et al. |
| 3,641,577 | A | | 2/1972 | Tocquec |
| 3,852,765 | A | | 12/1974 | Bresler et al. |
| 4,195,302 | A | | 3/1980 | Leupelt |
| 4,355,314 | A | * | 10/1982 | Ohm ..... 343/779 |
| 5,459,475 | A | | 10/1995 | Shen et al. |
| 6,052,094 | A | | 4/2000 | Kharadly et al. |

(Continued)

OTHER PUBLICATIONS

M.M.Z. Kharadly et al., "Effect of Wet Antenna Attenuation on Propagation Data Statistics," IEEE Transactions on Antennas and Propagation, vol. 49, No. 8, Aug. 2001, pp. 1183-1191.

(Continued)

*Primary Examiner*—Shih-Chao Chen
(74) *Attorney, Agent, or Firm*—Marger Johnson & McCollom, P.C.

(57) ABSTRACT

A reflector antenna includes a feed configured to always point during operation in a direction that opposes ingress of water into the feed, and a reflector having a truncated spherical reflecting surface, wherein a relative orientation of the reflector and the feed is adjustable. Another reflector antenna includes a feed configured to always point during operation in a direction that opposes ingress of water into the feed, and a reflector spaced apart from the feed by a focal length at least as great as a diameter of the reflector. Another reflector antenna includes a feed and a reflector having a truncated spherical reflecting surface, wherein the reflector is spaced apart from the feed by a focal length at least as great as a diameter of the reflector.

36 Claims, 9 Drawing Sheets

U.S. PATENT DOCUMENTS

| | | | | |
|---|---|---|---|---|
| 6,204,822 | B1 | 3/2001 | Cardiasmenos et al. | |
| 6,208,312 | B1 * | 3/2001 | Gould | 343/840 |
| 6,882,323 | B2 * | 4/2005 | Peebles et al. | 343/781 R |

OTHER PUBLICATIONS

M.M.Z. Kharadly et al., "Evaluation of Some Conventional Terminal Antennas' Performance in Rain at Ka-Band Frequencies," Proc. 7th Ka-Band Utilization Conference, Sante Marghorita Ligure, Genoa, Italy, Sep. 2001, pp. 303-308.

M. Kharadly et al., "Analysis of the ACTS-Vancouver Path Propagation Data," Proc. NAPEX XX and ACTS Prop. Studies Mini Workshop, Fairbanks, Alaska, Jun. 1996, pp. 67-83.

J.Y.C. Cheah, "Wet Antenna Effect on VSAT Rain Margin," IEEE Transactions on Communications, vol. 41, No. 8, Aug. 1993, pp. 1238-1244.

M.M.Z. Kharadly et al., "New Antenna Concept for Efficient Ka-Band Terminal Operation in Rain," Proc. 4th Ka-Band Utilization Conference, Venice, Italy, Nov. 1998, pp. 223-230.

M.M.Z. Kharadly, et al., "A Reflector Antenna for Operation in Rain at MM-Wavelengths", 11$^{th}$ Ka and Broadband Communications Conference and 23$^{rd}$ AIAA International Communications Satellite Systems Conference (ICSSC—2005), Sep. 25-28, 2005, Rome, Italy.

T. M. Street "An Experimental Investigation of a Spherical Reflector Antenna for Operation in Rain at Millimeter Wavelengths" Thesis, May 2005, Department of Electrical and Computer Engineering, Faculty of Applied Science, The University of British Columbia.

* cited by examiner

REFLECTOR ANTENNA

CROSS-REFERENCE TO RELATED APPLICATIONS

This application claims the benefit of priority from U.S. patent application Ser. No. 60/662,822 filed Mar. 18, 2005, and from U.S. patent application Ser. No. 60/719,600 filed Sep. 23, 2005.

FIELD OF THE INVENTION

The present invention relates to electromagnetic radiation such as radio waves for example, and more particularly, to reflector antennas.

BACKGROUND OF THE INVENTION

Many applications involve the use of reflector antennas. For example, satellite communications in frequency bands such as the Ka-band typically rely upon ground-based reflector antennas to transmit communication signals to and receive communication signals from orbiting satellites. Such satellites have either geosynchronous orbits (so that the orientation of the antenna may be fixed, always pointing at the satellite) or non-geosynchronous orbits (requiring the antenna to scan across the sky to track a satellite's path). A typical reflector antenna includes a reflector dish for reflecting signals from the satellite to a "feed" for signal reception, or for reflecting signals from the feed to the satellite for signal transmission.

For various reasons, including attenuation and field of view for example, reflector antennas are typically located outdoors, such as on building rooftops or at other locations often having high elevations. However, locating antennas outdoors poses various difficulties, including attenuation or signal loss when the antenna is exposed to rain. To attempt to protect the feed of a conventional antenna from rain and other deleterious exposure to the elements, the feed is typically surrounded by a "radome", i.e., a protective cover, typically composed of a dielectric (insulator) such as plastic, for example.

SUMMARY OF THE INVENTION

The present inventor has previously studied the effects of wet antenna attenuation on propagation data statistics. The present inventor has concluded that the dominant source of attenuation or signal loss caused by rain arises from wet surfaces of the radome, or from other wet radiating surfaces associated with the feed. The present inventor has also concluded that wetness of the reflector dish itself results in comparatively minor attenuation, and attenuation from the instantaneous rate of rain falling through the air between the feed and the reflector tends to be negligible in comparison to attenuation caused by wet antenna surfaces.

In accordance with one illustrative embodiment of the invention, there is provided an antenna including a feed and a reflector. The feed is configured to always point during operation in a direction that opposes ingress of water into the feed. The reflector has a truncated spherical reflecting surface. A relative orientation of the reflector and the feed is adjustable.

Advantageously, such a configuration of the feed minimizes the likelihood that the radiating surfaces of the feed will become wet, and allows the usual radome to be omitted, thereby removing the dominant source of attenuation caused by rain in conventional reflector antenna systems. As a further advantage, the truncated spherical reflecting surface permits the inclination and orientation of the reflector relative to the feed to be changed, without requiring movement of the feed.

In accordance with another illustrative embodiment of the invention, there is provided an antenna including a feed and a reflector. The feed is configured to always point during operation in a direction that opposes ingress of water into the feed. The reflector is spaced apart from the feed by a focal length at least as great as a diameter of the reflector.

Advantageously, in such an embodiment, the focal length to diameter ratio (F/D), which is larger than F/D ratios typically employed in previously existing reflector antennas having spherical reflecting surfaces, tends to further reduce attenuation caused by rain.

In accordance with another illustrative embodiment of the invention, there is provided an antenna including a feed and a reflector. The reflector has a truncated spherical reflecting surface, and the reflector is spaced apart from the feed by a focal length at least as great as a diameter of the reflector.

In accordance with another illustrative embodiment of the invention, there is provided an antenna including a feed and a reflector. The feed is configured to always point during operation in a direction that opposes ingress of water into the feed. The reflector has a truncated spherical reflecting surface, and the reflector is spaced apart from the feed by a focal length at least as great as a diameter of the reflector.

In such illustrative embodiments of the invention, the feed may be configured to always point substantially vertically downward during operation. For example, the feed may be configured to always point vertically downward. This may be achieved by having the feed fixed in the direction that opposes ingress, for example.

The feed may have a shape that repels rain when the feed is pointing in the direction that opposes ingress. For example, the feed may include a feedhorn, which may have a generally pyramidal shape. Alternatively, the feedhorn may have a generally conical shape, for example.

The reflector may be spaced apart from the feed by a focal length at least as great as a diameter of the reflector. For example, the focal length may be at least twice as great as a diameter of the reflector. As a further example, the focal length may be at least two-and-a-half times as great as a diameter of the reflector.

The reflector may have a truncated spherical reflecting surface, which may have a radius of curvature at least as great as a diameter of the reflector. For example, its radius of curvature may be at least three times as great as a diameter of the reflector. As a further example, its radius of curvature may be at least five times as great as a diameter of the reflector.

The antenna may exclude a radome. Advantageously, attenuation effects associated with wet radome surfaces may thereby be avoided.

The reflecting surface of the reflector may include a solid surface.

Alternatively, the reflecting surface of the reflector may include at least one aperture through the reflecting surface. The at least one aperture may include a plurality of drainage apertures, for example. Each of the apertures may have a diameter less than one-eighth of a wavelength intended to be reflected by the reflector. For example, each of the apertures may have a diameter less than one-twentieth of a wavelength intended to be reflected by the reflector.

The reflector may be rotatable about each of two perpendicular axes. For example, one of the axes may be a vertical axis for azimuthal rotation of the reflector thereabout and the other one of the axes may be a horizontal axis for elevational rotation of the reflector thereabout.

The antenna may further include a waveguide in communication with the feed.

The antenna may also include a transducer in communication with the feed via the waveguide. The transducer may include a radio detector, for example. Alternatively, or in addition, the transducer may include a radio transmitter. Alternatively, or in addition, the transducer may include a radio transceiver.

In accordance with another illustrative embodiment of the invention, there is provided a method including configuring a feed of an antenna to always point in a direction that opposes ingress of water into the feed, and reflecting electromagnetic radiation to or from the feed using a reflector having a truncated spherical reflecting surface.

In accordance with another illustrative embodiment of the invention, there is provided a method including configuring a feed of an antenna to always point in a direction that opposes ingress of water into the feed, and reflecting electromagnetic radiation to or from the feed using a reflector spaced apart from the feed by a focal length at least as great as a diameter of the reflector.

In accordance with another illustrative embodiment of the invention, there is provided a method including reflecting electromagnetic radiation to or from a feed using a reflector having a truncated spherical reflecting surface spaced apart from the feed by a focal length at least as great as a diameter of the reflector.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention.

DETAILED DESCRIPTION

System Overview

Figure 1:
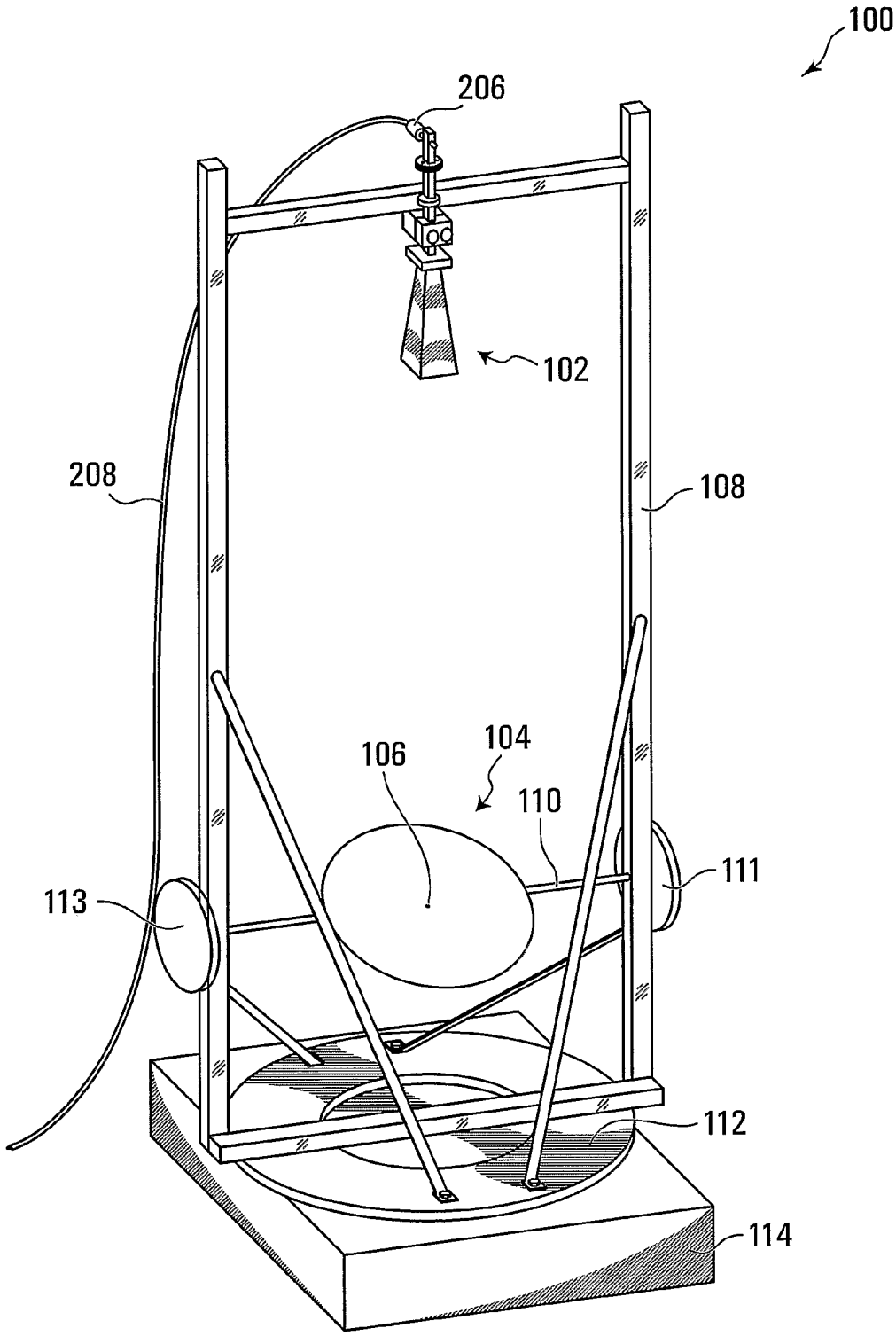
FIG. 1 is a perspective view of a reflector antenna according to a first embodiment of the invention.

Referring to FIG. 1, a reflector antenna according to a first embodiment of the invention is shown generally at 100. In this embodiment, the antenna 100 includes a feed shown generally at 102, and a reflector shown generally at 104. In the present embodiment, the feed 102 is configured to always point during operation in a direction that opposes ingress of water into the feed.

In this embodiment, the reflector 104 has a truncated spherical reflecting surface 106. Additionally in the present embodiment, the reflector 104 is spaced apart from the feed 102 by a focal length at least as great as a diameter of the reflector, as discussed in greater detail below.

In this embodiment, a relative orientation of the reflector 104 and the feed 102 is adjustable. To achieve this, in this embodiment the reflector is rotatable about each of two perpendicular axes. One of the axes is a vertical axis for azimuthal rotation of the reflector thereabout and the other one of the axes is a horizontal axis for elevational (altitude angle) rotation of the reflector thereabout. More particularly, in this embodiment the feed 102 is fixed to a vertically stable frame 108, and the reflector 104 is connected to a horizontal axle 110, which is rotatably connected at each end thereof to the frame 108, and which is also connected to rotation controls 111 and 113. In this embodiment, the rotation controls 111 and 113 are manually controlled and include both elevation or altitude angle indicator dials indicating the altitude angle $\theta$ above the horizon at which a target object such as a satellite is located, as well as inclination angle indicator dials indicating a corresponding inclination angle $\alpha$ of the reflector 104.

Figure 3:
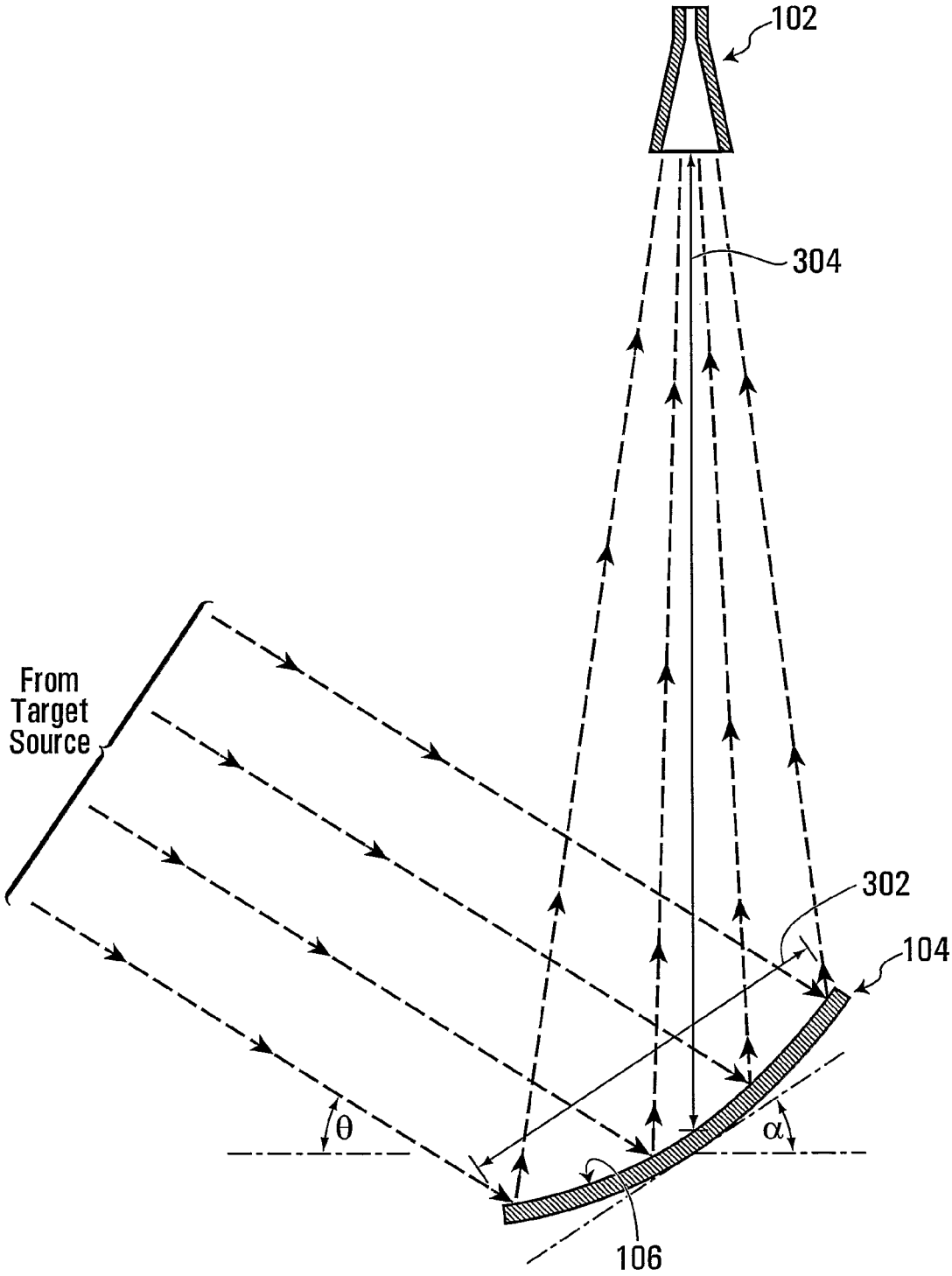
FIG. 3 is a cross-section of a feed and a reflector of the reflector antenna shown in FIG. 1.

In this regard, referring to FIG. 3, when the inclination angle is $\alpha=0$, the reflector is "flat" and is reflecting radiation to the feedhorn from a source located directly above, i.e. at the zenith, for which $\theta=90°$; similarly, when the inclination angle of the reflector is $\alpha=45°$, the reflector is reflecting radiation to the feedhorn from a source located at the horizon, for which $\theta=0°$. More generally, it can be shown that $\theta+2\alpha=90°$. Alternatively, it will be appreciated that only a single angle indicator (either altitude or inclination) will suffice. Or, as a further alternative, the rotation of the horizontal axle 110 may be electrically controlled, such as by a computer-controlled motor for example, if desired.

Referring back to FIG. 1, in this embodiment, an orientation of the reflector 104 relative to the fixed feed 102 is adjustable in two ways, by (in the case of elevation or altitude angle) rotating the horizontal axle 110 to rotate the reflector 104 about the axis of the horizontal axle, or (in the case of azimuth angle) by rotating the entire frame 108, including the feed 102 and the reflector 104, about a vertical axis (in this case the zenith) that extends through the centers of the reflector 104 and the feed 102. More particularly still, in this embodiment the frame 108 is rigidly mounted to a rotatable platform 112, which in turn is connected to a drive shaft of an electric motor (not shown) within a base assembly 114 upon which the platform 112 is rotatably mounted. In this embodiment, the base assembly 114 itself is fixed to the ground or to a platform (not shown) thereon, to stably support the frame 108 both at rest and during rotation of the platform 112. In the present embodiment, rotation of the electric motor causes rotation of the platform 112, to which the frame 108 is rigidly attached, about a vertical axis passing through the centers of the platform 112, the reflector 104 and the feed 102. The electric motor of the base assembly 114 may include a stepper motor, for example. The electric motor is preferably capable of being controlled to rotate the frame 108 accurately in small, precise angular increments. If desired, a control system (not shown) may be provided, to control the electric motor of the base assembly 114 to cause azimuthal rotation of the reflector about the vertical axis (i.e. the zenith), and to simultaneously control a similar optional electric motor (not shown) to cause altitude angle rotation of the reflector about the axis of the horizontal axle 110, to effectively progressively "scan" across the sky, to track non-geosynchronous orbit satellites, for example.

In this embodiment, the reflector 104 is rotatable about the axis of the horizontal axle 110 through inclination angles $\alpha$ ranging from 0° (i.e., "flat", facing vertically upwards) to 45°, effectively allowing the feed 102 to receive electromagnetic radiation from altitude angles $\theta$ ranging from 90° to 0°, i.e., from directly overhead to the horizon. Also in this embodiment, the frame 108 and platform 112 are rotatable through 360° about the vertical axis (i.e. the zenith). Alternatively, however, other angular ranges may be substituted. For example, an azimuthal angular range of 0° to 180° may be combined with an inclination range of −45° to +45°. As a further example, the antenna 100 does not necessarily have to be able to receive or transmit radiation in the horizontal direction, as objects such as buildings and trees sometimes obscure the horizon, and additional atmospheric attenuation also occurs at horizontal angles, with the result that the altitude angular range may be less, if desired.

Advantageously in this embodiment, the antenna 100 excludes a radome (i.e., a protective cover, generally made from a dielectric material, to protect the feed from rain and other elements). In this regard, the present inventor has found that water on dielectric surfaces of such radomes tends to cause significant attenuation of electromagnetic radiation intended to be received at or transmitted from the feed 102. Therefore, in this embodiment, because the feed 102 is configured to always point during operation in a direction that opposes ingress of water into the feed, the usual radome may be omitted, thereby avoiding this significant source of attenuation.

In this embodiment, the reflecting surface 106 of the reflector 104 includes a solid surface. Alternatively, however, the reflecting surface 106 may have perforations or small apertures defined therethrough, as discussed in greater detail below.

Feed

Figure 2:
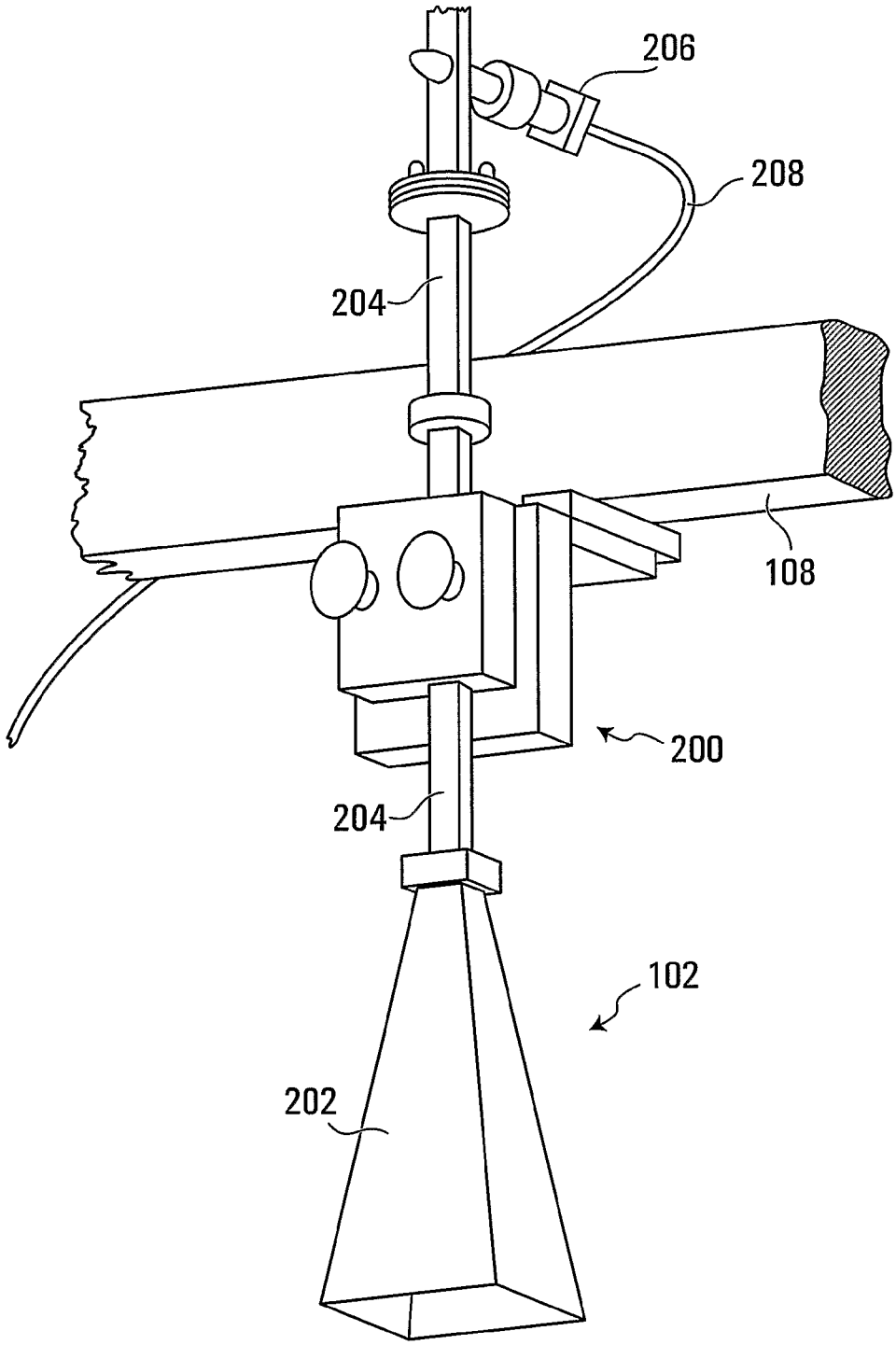
FIG. 2 is a perspective view of a feed and a detector of the reflector antenna shown in FIG. 1.

Referring to FIGS. 1 and 2, the feed is shown in greater detail at 102 in FIG. 2. In this embodiment, the direction that opposes ingress of water into the feed is substantially vertically downward, and thus, in the present embodiment the feed 102 is configured to always point substantially vertically downward during operation. More particularly, in this embodiment the feed 102 is configured to always point vertically downward when installed on the frame 108, regardless of whether it is in operation or not. Alternatively, however, it will be appreciated that the feed need not be pointing precisely downward, as deviations from a vertical orientation may still permit the feed 102 to be pointing in a direction that opposes ingress of water, depending upon the shape of the feed. In this embodiment, the feed is fixed to point in the direction that opposes ingress, which in this embodiment is vertically downward, by rigidly attaching the feed 102 to the frame 108 via mounting brackets shown generally at 200. Alternatively, however, the feed 102 may be moveable if desired. For example, the feedhorn may be rotatable about its vertical axis relative to the frame 108 to maintain a desired linear polarization, if desired. As a further example, the frame 108 may be adjustable to permit vertical movement of the feedhorn in order to change the effective focal length F between the feedhorn and the reflector (focal length is discussed in greater detail below). Or, as a further example, the feedhorn may be adjustable to point at different regions of the reflector, which may be particularly advantageous for embodiments in which the curvature of the reflecting surface of the reflector is not spherical.

In this embodiment, the feed 102 has a shape that repels rain when the feed is pointing in the direction that opposes ingress. More particularly, in this embodiment the feed 102 includes a feedhorn 202. More particularly still, in this embodiment the feedhorn 202 has a generally pyramidal shape, and has an inner rectangular aperture whose horizontal cross-sectional area decreases from the bottom of the feedhorn 202 to the top of the feedhorn. In this regard, a pyramidal-shaped feedhorn is particularly well-suited for applications involving linearly polarized electromagnetic radiation. Alternatively, however, a conical-shaped feedhorn may be substituted for applications involving circularly polarized electromagnetic radiation. In this embodiment, the feedhorn was made by placing a stainless steel former having finely ground smooth surfaces in an electrolyte bath for several weeks to deposit copper thereon. The resulting feedhorn 202 has a slightly rough outer surface but has an inner surface that tends to be considerably smoother than typical commercially available feedhorns, at a fraction of the cost.

In this embodiment, the slopes of the diverging sidewalls of the pyramidal-shaped feedhorn 202 are selected to provide an optimized value of the "edge taper" of the feedhorn radiation pattern, such as 8-10 dB, for electromagnetic radiation having a Ka-band frequency of 35 GHz, given the particular focal distance F of the feed from the reflector and for the particular diameter D of the reflector (discussed in greater detail below). In this regard, it will be appreciated that for a particular application, the precise shape and configuration of the feedhorn or other feed will be designed to optimize reception or transmission at one or more particular frequencies of interest, for the particular F/D ratio of the antenna. Too little edge taper may cause electromagnetic radiation to spill over the edges of the reflector, with undesirable side-lobes, while too sharp an edge taper may result in inefficient use of the reflector causing loss of gain and widening of the main beam. Thus, alternatively, other shapes or types of feedhorns, or more generally other types of feeds, may be substituted for particular applications.

In this embodiment, the antenna 100 further includes a waveguide 204 in communication with the feed 102, or more particularly with the feedhorn 202. In this embodiment, the waveguide serves as a conduit for electromagnetic radiation between the feed and a transducer (discussed below), and may also serve to limit undesirable higher-order modes. If desired, if the antenna 100 is being used for reception or transmission of linearly polarized electromagnetic radiation, the waveguide may further include a "twist" to allow only a desired polarization to pass.

Also in this embodiment, the antenna 100 includes a transducer 206 in communication with the feed 102 via the waveguide 204. In this embodiment, the transducer 206 includes a radio detector for reception of electromagnetic radiation at radio frequencies, such as Ka-band frequencies, for example. Alternatively, the transducer 206 may include a radio transmitter for transmission applications. Or, as a further alternative, the transducer 206 may include a radio transceiver for bidirectional radio communications. In this embodiment, the transducer 206 is in communication with further electronic communication equipment (not shown) via a cable 208.

Focal Length, Diameter and Radius of Curvature

Referring to FIGS. 1 and 3, the feed 102 and the reflector 104 are shown in FIG. 3, with remaining components of the antenna 100 omitted for clarity. In this embodiment, the reflector 104 has a diameter ("D") 302, and the feed 102 is spaced apart from the reflector 104 by a focal length ("F") 304.

In this embodiment, the reflector 104 is spaced apart from the feed 102 by a focal length F at least as great as a diameter D of the reflector. More particularly, in this embodiment the focal length is at least twice as great as the diameter of the reflector. More particularly still, in this embodiment the focal length is at least two-and-a-half times as great as the diameter of the reflector. In this embodiment, the diameter 302 of the reflector 104 is D=30 cm, and the focal length 304 is F=75 cm. In this regard, it will be appreciated that the F/D ratio, which in this embodiment is 2.5, is significantly greater than the F/D ratio for typical conventional spherical reflector antennae, which tend to use small F/D ratios, typically less than unity. Alternatively, other suitable dimensions may be substituted. For example, the F/D ratio may be considerably larger than 2.5, subject to any limits that may arise due to uncorrected spherical aberration in a particular embodiment. As a further example, an F/D ratio smaller than 2.5 may be substituted if desired.

As noted earlier herein, in this embodiment the reflecting surface of the reflector 104 is the truncated spherical reflecting surface 106. Advantageously in the present embodiment, in which the feed 102 is fixed and the reflector 104 can be rotated and inclined relative to the feed, the spherical curvature of the reflecting surface 106 causes the reflecting surface 106 to effectively have the same reflecting properties relative to the feed 102 as the inclination angle of the reflector 104 changes. In contrast, use of other shapes for the reflecting surface, such as a parabolic shape for example, typically requires the feed to point at different sections of the reflecting surface for different respective inclination angles of the reflector. Alternatively, however, parabolic or other shapes may be substituted for the reflecting surface if desired.

In this embodiment, the truncated spherical reflecting surface 106 has a radius of curvature R, i.e., a radius of a hypothetical sphere of which the reflecting surface 106 may be viewed as a truncated segment or inverted "cap". In this embodiment, the radius of curvature of the truncated spherical reflecting surface 106 is at least as great as the diameter 302 of the reflector 104. More particularly, in this embodiment reflecting surface 106 has a radius of curvature at least three times as great as the diameter 302 of the reflector. More particularly still, in this embodiment the reflecting surface 106 has a radius of curvature at least five times as great as the diameter 302 of the reflector. Thus, in the present embodiment, in which the diameter 302 of the reflector 104 is D=30 cm, the radius of curvature of the reflecting surface 106 is R=150 cm.

Experimental Data from an Illustrative Embodiment

Referring back to FIG. 1, experiments have been conducted using a prototype antenna similar to the antenna 100 shown in FIG. 1, in receiving mode. As with the antenna 100, the tested prototype antenna had a focal length of F=75 cm, the reflector had a diameter of D=30 cm, and the reflector had a truncated spherical reflecting surface whose radius of curvature was R=150 cm. The prototype antenna was placed an appropriate distance from a transmitting antenna (not shown). Motorized rotation of the platform 112 enabled convenient automated radiation pattern measurements in the horizontal (ϕ) plane, while measurements in the vertical (θ) plane were achieved by manual rotation of the rotation controls 111 and 113. The frame 108 was adjustable to allow the feedhorn 202 to be moved vertically to change the focal length.

Measurements were conducted using a rain simulation apparatus (not shown) to simulate rain. The rain simulation apparatus included a system of eight elevated sprinklers whose spray was directed upwards before the water drops fell on the antenna. The sprinklers were adjustable to produce showers of a wide range of drop size, to simulate mist-like rain to heavy thunder showers.

Measurements were carried out at three illustrative frequencies, namely, 27.5 GHz, 31.5 GHz and 35 GHz, for three elevation angles, namely, 10°, 30° and 50°.

Figure 6A:
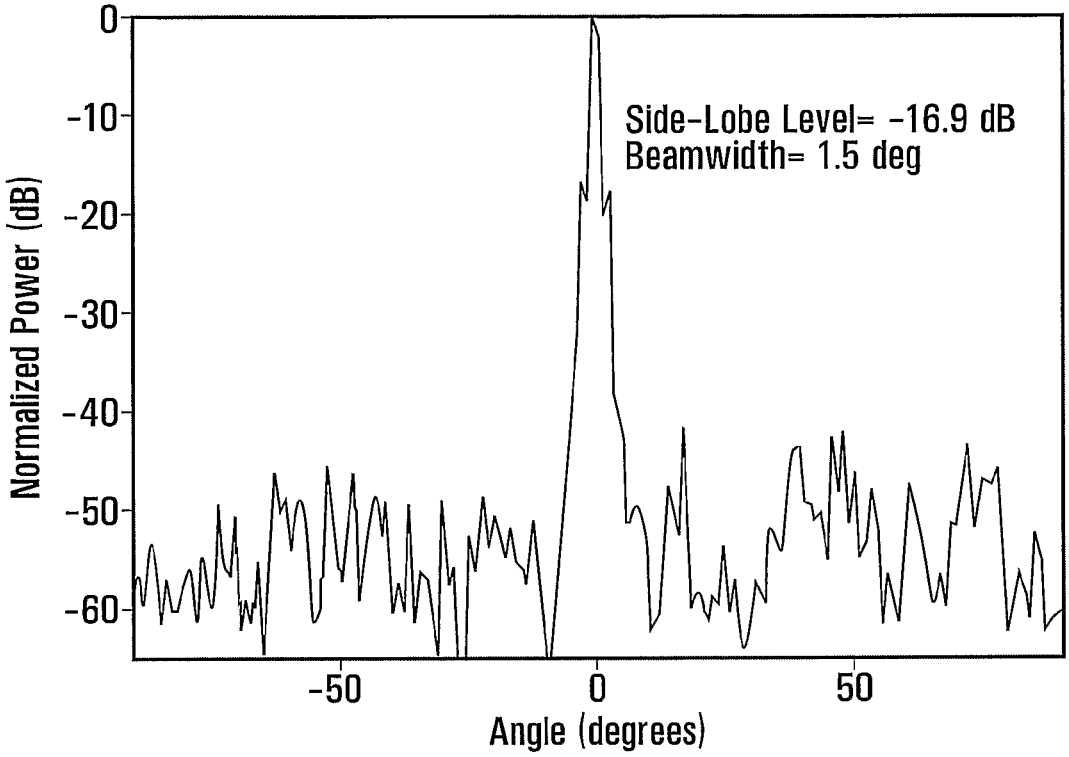
FIGS. 6*a* and 6*b* are graphical representations of antenna radiation pattern measurements of an illustrative embodiment of the invention at a frequency of 35 GHz.
Figure 6B:
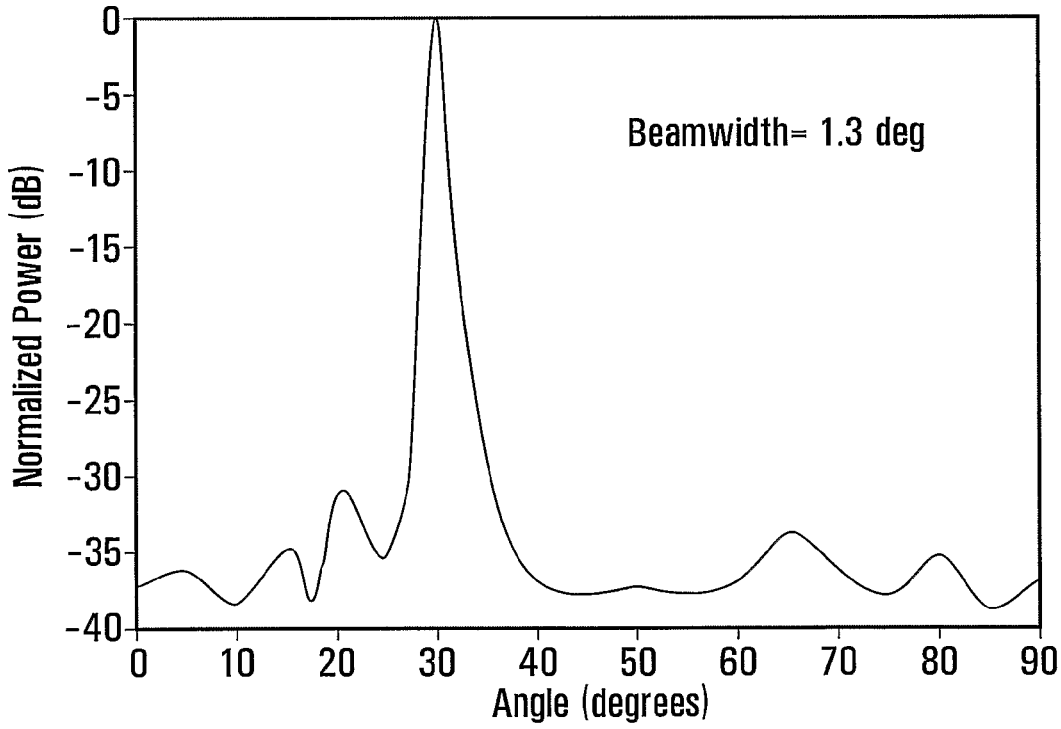

FIGS. 6(*a*) and 6(*b*) show examples of the measured antenna radiation patterns measurements in the H-plane and E-plane, respectively. The patterns shown in FIGS. 6(*a*) and 6(*b*) were obtained at a frequency of 35 GHz and an elevation angle of 30°.

Tables 1 and 2 show parameters of the measured radiation characteristics, namely, first side-lobe levels (SLL) and 3-dB beam width (BW), for measured frequencies and elevation angles.

TABLE 1

Antenna Radiation Characteristics, H-Plane

| | Elevation Angle | | | | | |
|---|---|---|---|---|---|---|
| | 10° | | 30° | | 50° | |
| Frequency (GHz) | SLL (dB) | BW (deg) | SLL (dB) | BW (deg) | SLL (dB) | BW (deg) |
| 27.5 | −14.2 | 3.7 | −12 | 2.4 | −16.6 | 3.4 |
| 31.5 | −15.5 | 2.5 | −12.4 | 2.3 | −19.9 | 2.6 |
| 35 | −17 | 1.9 | −16.9 | 1.5 | −20.4 | 2.2 |

TABLE 2

Antenna Radiation Characteristics, E-Plane

| | Elevation Angle | | |
|---|---|---|---|
| Frequency (GHz) | 10° BW (deg) | 30° BW (deg) | 50° BW (deg) |
| 27.5 | 1.8 | 2.8 | 1.4 |
| 31.5 | 1.6 | 1.8 | 1.3 |
| 35 | 1.5 | 1.3 | 1.1 |

Figure 7A:
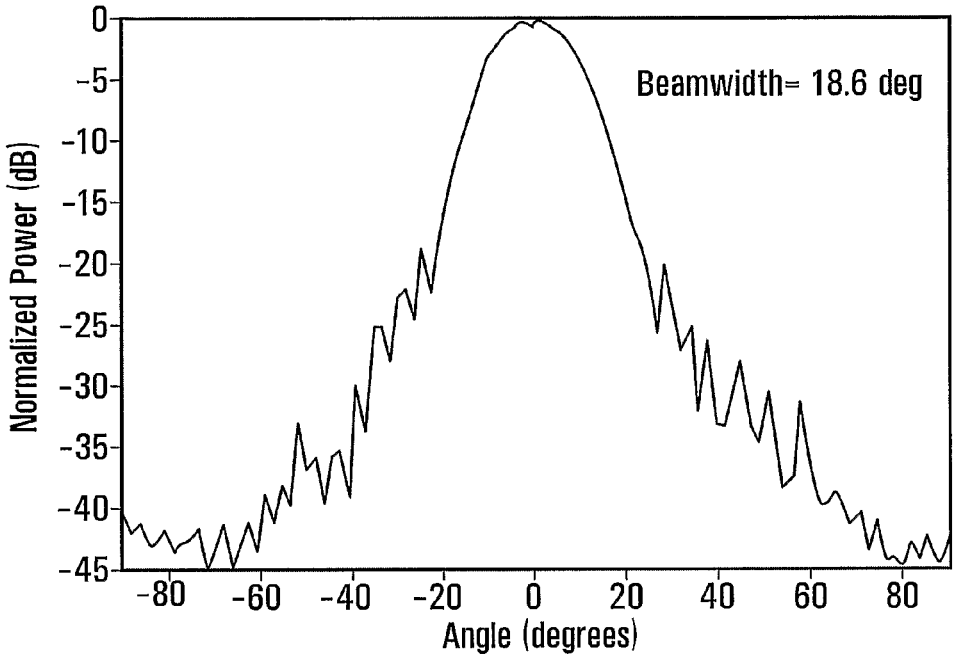
FIGS. 7*a* and 7*b* are graphical representations of feedhorn radiation pattern measurements of an illustrative embodiment of the invention at a frequency of 35 GHz.
Figure 7B:
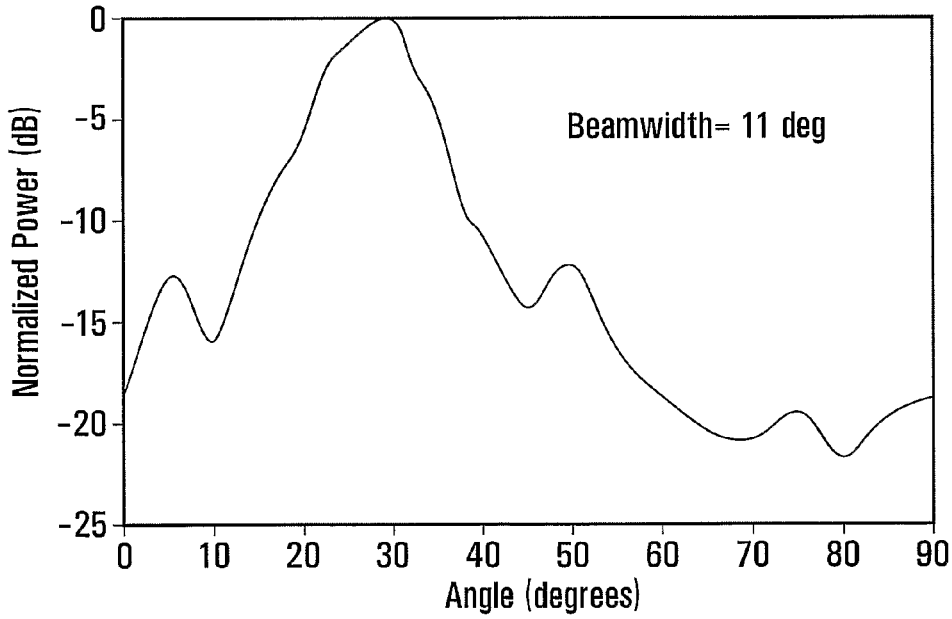

The feed horn H and E planes radiation patterns measured at 35 GHz are shown in FIGS. 7(*a*) and 7(*b*), respectively. A summary of the characteristics at the measured frequencies is shown in Table 3, which also shows edge-taper characteristics.

TABLE 3

Feed Horn Characteristics

| Frequency | 3-dB Beam Width (deg) | | Edge Taper (dB) | |
|---|---|---|---|---|
| (GHz) | H-plane | E-plane | H-plane | E-plane |
| 27.5 | 23 | 18 | 2.8 | 4.1 |
| 31.5 | 20 | 16 | 3.8 | 6.1 |
| 35 | 19 | 11 | 4.1 | 9.6 |

Figure 8A:
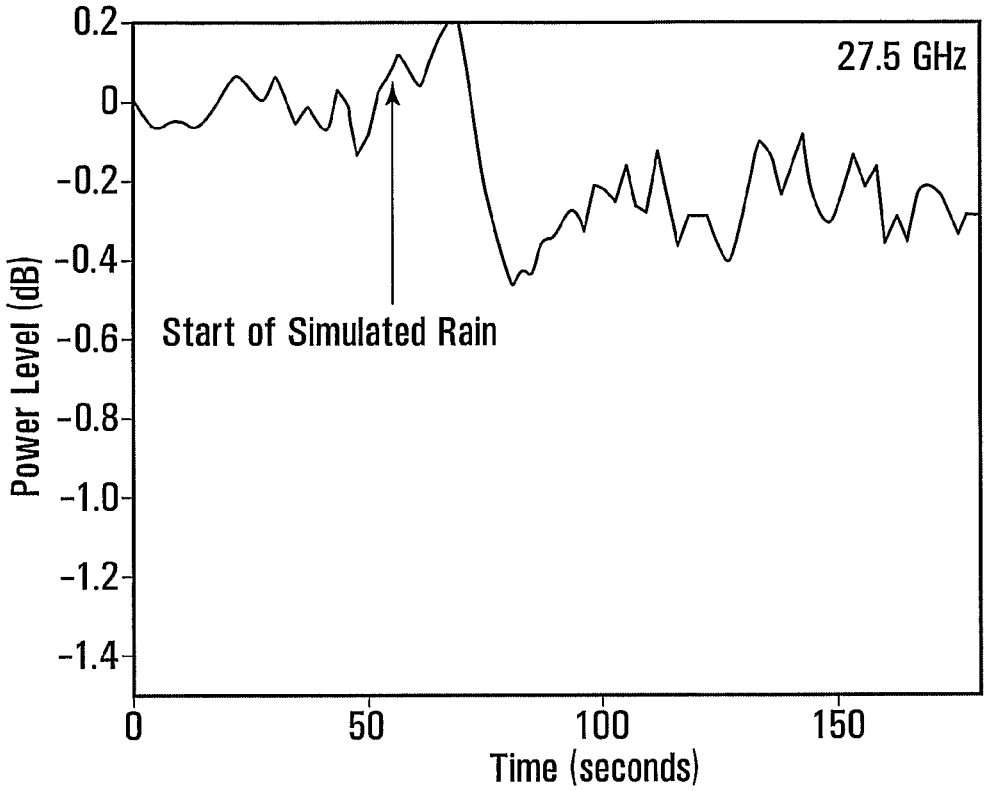
FIGS. 8*a*, 8*b* and 8*c* are graphical representations of samples of measured attenuation versus time, at three respective frequencies of 27.5 GHz, 31.5 GHz and 35 GHz, respectively.
Figure 8B:
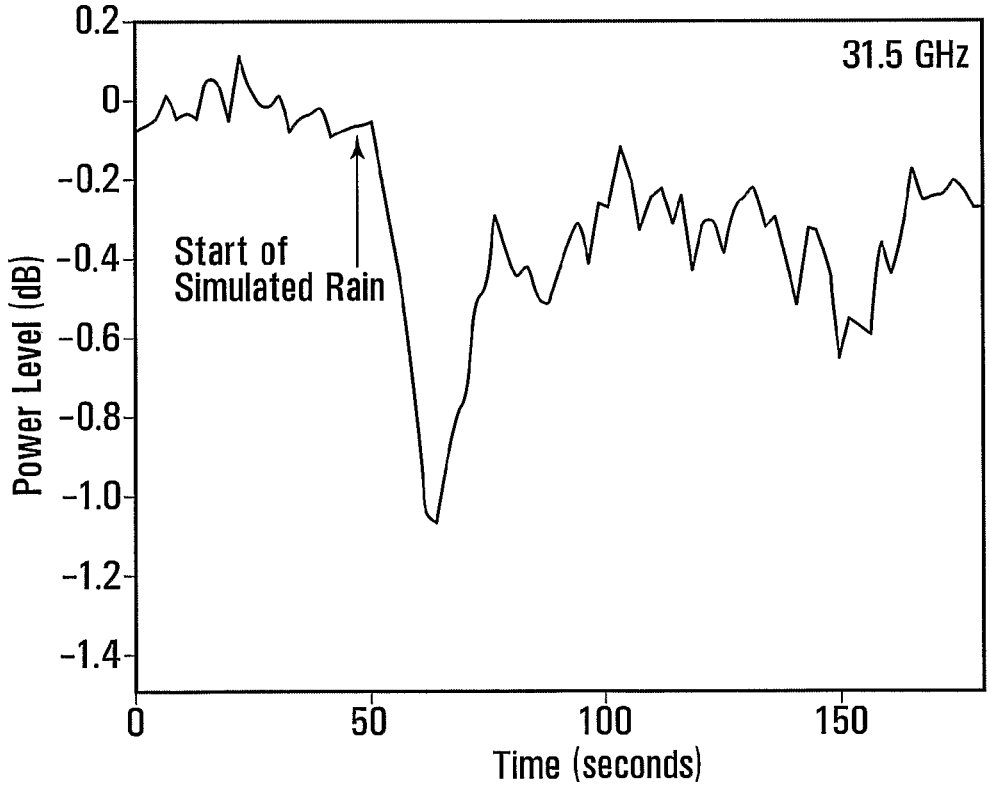
Figure 8C:
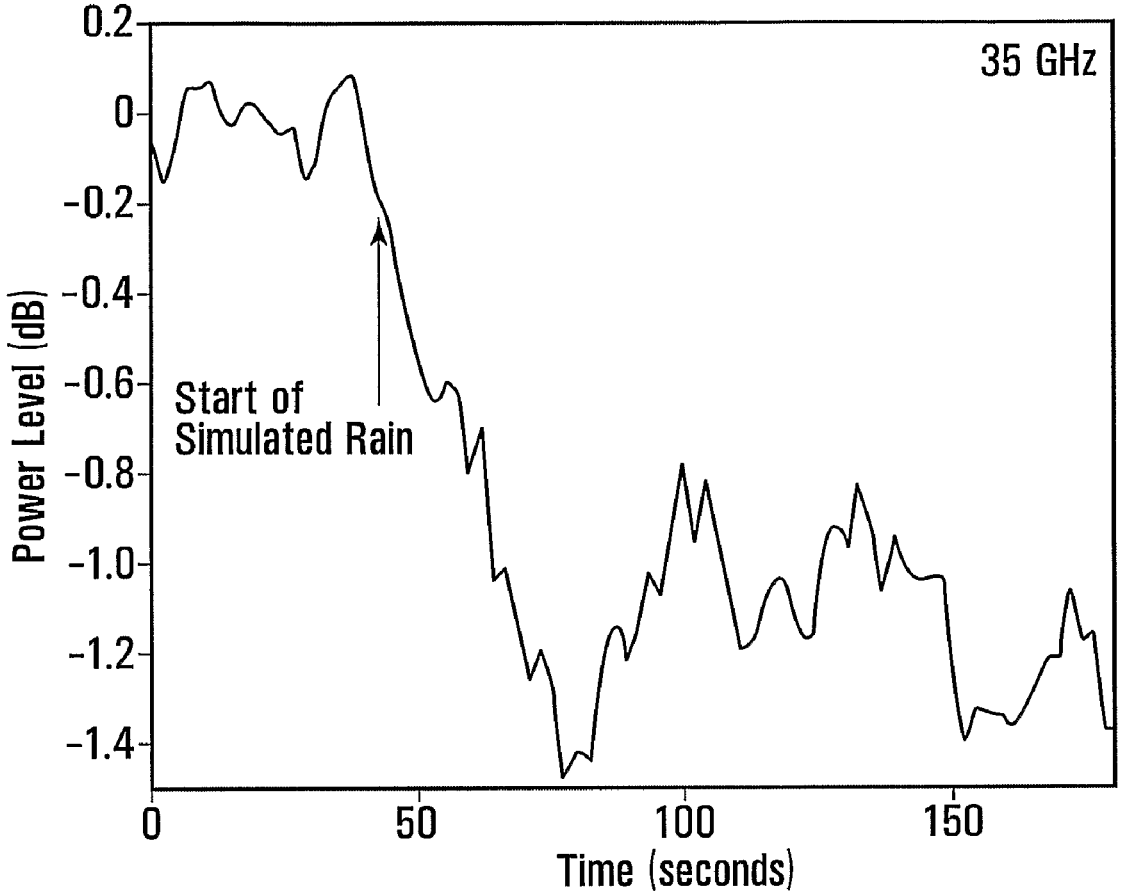

FIGS. 8(*a*), (*b*) and (*c*) show examples of received signal strength versus time during wetting experiments at 27.5, 31.5 and 35 GHz, respectively, at angle (θ) of 30°. A summary of wet-antenna attenuation results is given in Table 4 for all frequencies and angles of incidence.

TABLE 4

| Summary of Wet-Attenuation Results | | | | | | | | | |
|---|---|---|---|---|---|---|---|---|---|
| Frequency (GHz) | Attenuation (dB) | | | | | | | | |
| | α = 20° | | | α = 30° | | | α = 40° | | |
| | high | low | avg | high | low | avg | high | low | avg |
| 27.5 | 0.9 | 0.5 | 0.7 | 0.5 | 0.1 | 0.3 | 0.3 | 0 | 0.1 |
| 31.5 | 1.4 | 0.7 | 0.9 | 1.1 | 0.1 | 0.5 | 1.0 | 0.1 | 0.3 |
| 35 | 1.6 | 1.0 | 1.3 | 1.5 | 0.8 | 1.1 | 1.0 | 0.6 | 0.8 |

Table 5 shows approximate results of cross-polar discrimination measurements carried out under dry and wet conditions.

TABLE 5

| Cross-polar Discrimination | | | | | | |
|---|---|---|---|---|---|---|
| Reflector Inclination Angle | 27.5 GHz | | 31.5 GHz | | 35 GHz | |
| (α) | dry | wet | dry | wet | dry | wet |
| 20° | 34 | 34 | 35 | 34 | 30 | 32 |
| 30° | 34 | 36 | 33 | 34 | 28 | 30 |
| 40° | 33 | 34 | 31 | 32 | 28 | 27 |

Alternatives

In the foregoing discussion, a single embodiment was shown as including the following three features (among others): (1) the feed 102 is configured to always point during operation in a direction that opposes ingress of water into the feed; (2) the reflector 104 has a truncated spherical reflecting surface 106; and (3) the reflector 104 is spaced apart from the feed 102 by a focal length at least as great as a diameter of the reflector, as discussed in greater detail below. Alternatively, however, subcombinations of such features may be substituted. For example, one illustrative embodiment may include features (1) and (2) but not (3); another illustrative embodiment may include features (1) and (3) but not (2); a further illustrative embodiment may include features (2) and (3) but not (1); further illustrative embodiments may include only one of these three features, either alone or in combination with other features. More generally, one, two or all three of these features may be omitted if desired.

Figure 4:
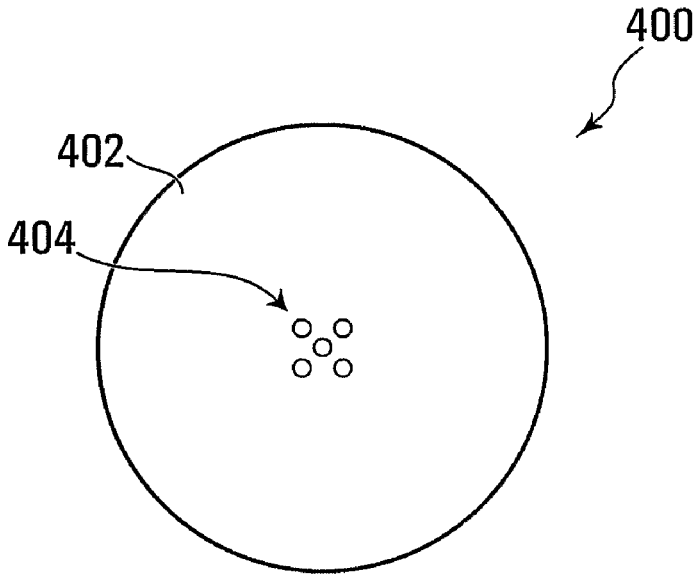
FIG. 4 is a top plan view of a reflector of a reflector antenna according to a second embodiment of the invention.

Referring to FIGS. 1 and 4, a reflector according to a second embodiment of the invention is shown generally at 400 in FIG. 4. Unlike the solid reflecting surface 106 of the reflector 104 shown in FIG. 1, in this embodiment a reflecting surface 402 of the reflector 400 includes at least one aperture shown generally at 404 through the reflecting surface. More particularly, in this embodiment the at least one aperture 404 includes a plurality of drainage apertures. In this embodiment, each of the apertures has a diameter less than one-eighth of a wavelength intended to be reflected by the reflector. More particularly, in this embodiment each of the apertures has a diameter less than one-twentieth of a wavelength intended to be reflected by the reflector. In this regard, it will be appreciated that in general, holes in a reflecting surface that are smaller than one-twentieth of the wavelength to be reflected do not appreciably reduce the intensity of reflection of that wavelength by the reflecting surface (similar to the perforations in a microwave oven door, which do not permit the long-wavelength microwaves to pass therethrough). For some applications, even larger holes, on the order of one-eighth of the wavelength to be reflected, will not appreciably reduce the intensity reflected by the reflecting surface. Thus, for a convenient numerical example of 30 GHz electromagnetic radiation signals (1 cm wavelength), the apertures are preferably less than one-eighth of one centimeter in diameter, and are more preferably less than one-twentieth of one centimeter in diameter. Such apertures may be provided to permit water to drain away from the dish. Alternatively, however, such drainage apertures may be omitted, as the present inventor has found that attenuation due to a wet reflecting surface is relatively minor compared to the considerably greater attenuation that occurs in conventional systems due to wet radomes or other radiating surfaces associated with the feed, and moreover, wetness of the reflector tends to be naturally diminished at certain inclination angle ranges of the reflector.

Figure 5:
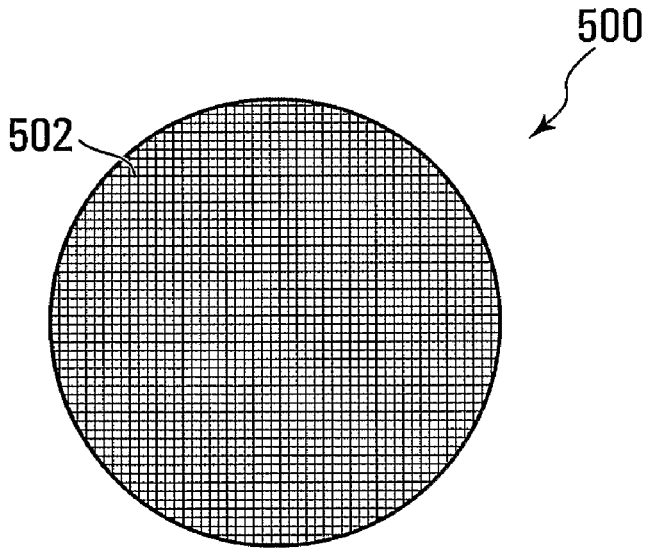
FIG. 5 is a top plan view of a reflector of a reflector antenna according to a third embodiment of the invention.

Similarly, referring to FIG. 5, a reflector according to a third embodiment of the invention is shown generally at 500 in FIG. 4. In this embodiment, a reflecting surface 502 of the reflector 500 includes at least one aperture. More particularly, in this embodiment the at least one aperture includes a plurality of drainage apertures. More particularly still, in the present embodiment the reflector 500 is constructed as a truncated, spherically curved lattice, defining apertures between intersecting perpendicular lattice strips. As with the previous embodiment, in this embodiment each of the apertures has a diameter less than one-eighth of a wavelength intended to be reflected by the reflector, and preferably less than one-twentieth of a wavelength intended to be reflected by the reflector.

Although a specific frame 108 was described in connection with the embodiment shown in FIG. 1, alternatively, any other suitable way of mounting the reflector and the feed may be substituted.

Figure 9:
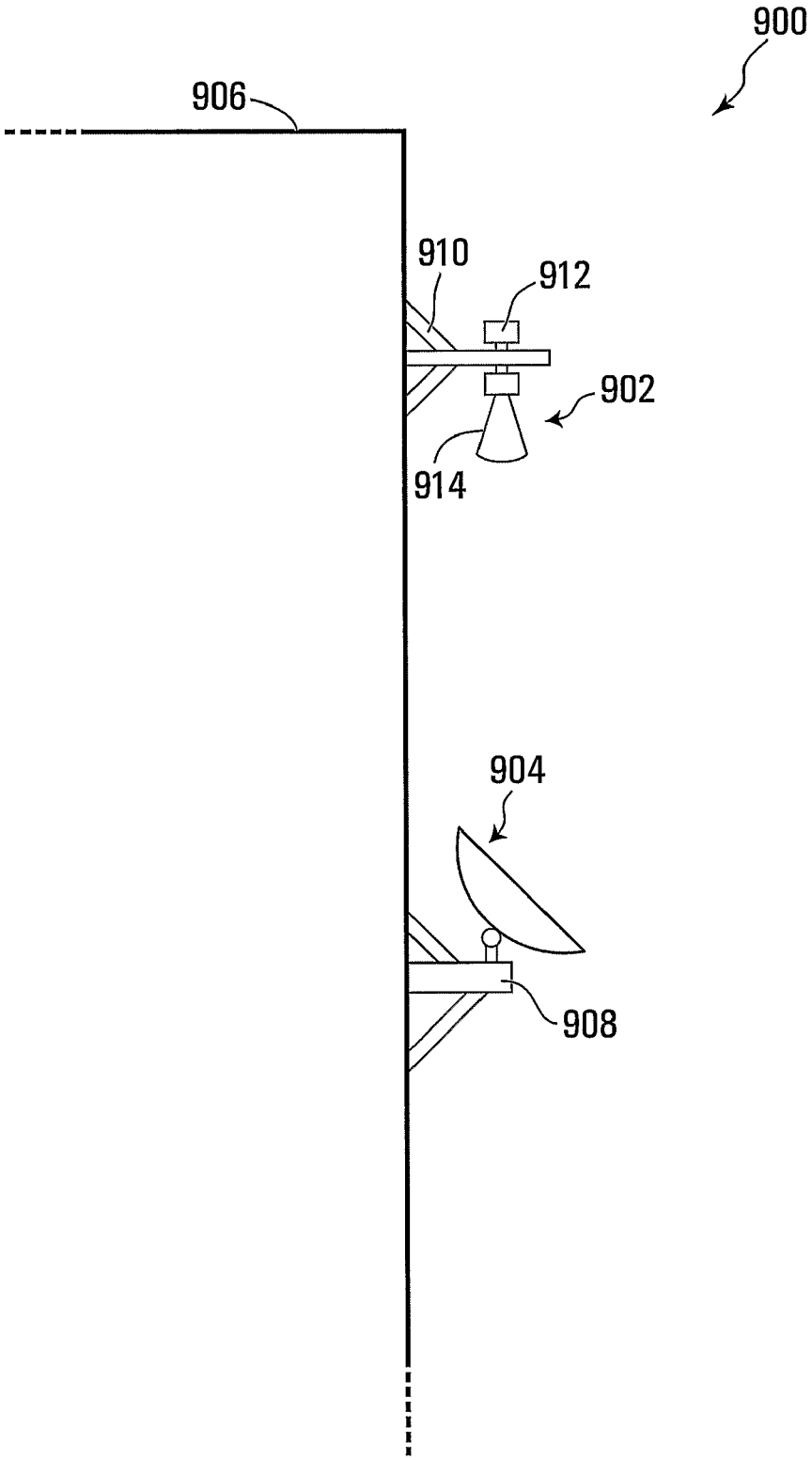
FIG. 9 is a side elevation view of a reflector antenna according to a fourth embodiment of the invention.

For example, referring to FIG. 9, a reflector antenna according to a fourth embodiment of the invention is shown generally at 900. In this embodiment, the antenna 900 includes a feed 902 and a reflector 904. In this embodiment, however, the feed 902 and the reflector 904 are not mounted to a common frame, but rather, are separately mounted to a side wall of a building 906. More particularly, in this embodiment, the reflector 904 is rotatably attached to a reflector mounting member 908, which in turn is rigidly attached to a side wall of the building. In this embodiment, the reflector mounting member 908 includes a first internal electric motor for causing azimuthal angle rotation of the reflector 904 about a vertical axis, and a second internal electric motor for causing elevation or altitude angle rotation of the reflector 904 about a horizontal axis. In this embodiment, electric power and rotational control signals for the electric motors are supplied from a control unit (not shown) located inside the building, via cables (not shown) routed through the reflector mounting member 908. The feed 902 is attached to the same wall directly above the reflector 904, using a feed mounting member 910 rigidly mounted to the wall. In this embodiment, the feed 902 is in communication via a waveguide with a transducer, or more particularly, with a detector 912, which in turn is in communication with the control unit (not shown) inside the building via cables routed through the feed mounting member 910. The detector 912 may further include any circuitry appropriate to the application in question, such as a single or dual Low Noise Block (LNB) for certain satellite television applications, for example.

Alternatively, the mounting members 908 and 910 may be combined into a single integral mounting member (not shown), to facilitate accurate focal length spacing of the feed 902 from the reflector 904. If desired, such an integral mounting member may have a focal length spacing that is adjustable prior to affixing the mounting member to the wall of the building.

In the present embodiment, the feed 902 is configured to always point during operation in a direction that opposes ingress of water into the feed. More particularly, in this embodiment the feed 902 is rigidly fixed to the feed mounting member 910 in a direction pointing vertically downward, although alternatively, the feed 902 may be moveable if desired. Also in this embodiment, the reflector 904 has a truncated spherical reflecting surface, although alternatively, other suitable reflecting surfaces may be substituted. Also in this embodiment, the feed 902 is spaced apart from the reflector 904 by a focal length at least as great as a diameter of the reflector 904. More particularly, in this embodiment the focal length is 2.5 times as great as the diameter of the reflector 904, although alternatively, relatively longer (or shorter) focal lengths may be substituted if desired.

In this embodiment, the feed 902 has a shape that repels rain when the feed is pointing in the direction that opposes ingress (in this example, vertically downward). More particularly, in this embodiment the feed 902 includes a feedhorn 914. However, unlike the pyramidal feedhorn described in connection with FIGS. 1 and 2, in this embodiment the feedhorn has a conical shape. In this regard, it will be appreciated that a conical-shaped feedhorn is more appropriate for circularly polarized electromagnetic radiation, whereas a pyramidal-shaped feedhorn is more appropriate for linearly polarized electromagnetic radiation.

The antenna 900 shown in FIG. 9 or a similar configuration may be particularly suitable for installations at customer premises, on the walls of buildings such as houses, apartment buildings or office buildings. For example, the antenna 900 may include a Very Small Aperture Terminal (VSAT), which may be used as a consumer reception antenna for satellite-based television, radio or high-speed data download services, for example.

Alternatively, however, embodiments of the present invention may also be suitable for much larger antennas, which may include much larger reflectors, such as antennas used for transmitting telecommunications signals to satellites for retransmission by the satellites, for example.

Although the embodiment shown in FIG. 1 was described as being configured and optimized for Ka-band frequencies, alternatively, embodiments of the invention may be configured for reception and/or transmission of other frequencies or frequency bands. For example, embodiments of the invention may also be applied to higher frequencies (shorter wavelengths) or bands than Ka-band. Conversely, embodiments of the invention may be applied to lower frequencies (longer wavelengths) or bands than Ka-band, notably including Ku-band, which (like Ka-band) tends to be more susceptible to rain attenuation than C-band. Similarly, embodiments of the invention may also be applied to other lower frequency bands such as K-band, X-band, S-band, C-band or L-band, for example.

More generally, while specific embodiments of the invention have been described and illustrated, such embodiments should be considered illustrative of the invention only and not as limiting the invention as construed in accordance with the accompanying claims.

What is claimed is:

1. An antenna comprising:

a) a feed configured to always point during operation in a direction that opposes ingress of water into the feed, wherein the direction is substantially vertically downward; and b) a reflector having a truncated spherical reflecting surface;

wherein a relative orientation of said reflector and said feed is adjustable.

2. The antenna of claim 1 wherein the feed is configured to always point vertically downward.

3. The antenna of claim 1 wherein the feed is fixed in said direction that opposes ingress.

4. The method of claim 1 wherein the feed has a shape that repels rain when the feed is pointing in said direction that opposes ingress.

5. The antenna of claim 1 wherein the feed comprises a feedhorn.

6. The antenna of claim 5 wherein the feedhorn has a generally pyramidal shape.

7. The antenna of claim 5 wherein the feedhorn has a generally conical shape.

8. The antenna of claim 1 wherein the reflector is spaced apart from the feed by a focal length at least as great as a diameter of the reflector.

9. The antenna of claim 1 wherein the reflector is spaced apart from the feed by a focal length at least twice as great as a diameter of the reflector.

10. The antenna of claim 1 wherein the reflector is spaced apart from the feed by a focal length at least two-and-a-half times as great as a diameter of the reflector.

11. The antenna of claim 1 wherein said truncated spherical reflecting surface has a radius of curvature at least as great as a diameter of said reflector.

12. The antenna of claim 1 wherein said truncated spherical reflecting surface has a radius of curvature at least three times as great as a diameter of said reflector.

13. The antenna of claim 1 wherein said truncated spherical reflecting surface has a radius of curvature at least five times as great as a diameter of said reflector.

14. The antenna of claim 1 wherein the antenna excludes a radome.

15. The antenna of claim 1 wherein the reflecting surface of the reflector comprises a solid surface.

16. The antenna of claim 1 wherein the reflecting surface of the reflector comprises at least one aperture through the reflecting surface.

17. The antenna of claim 16 wherein the at least one aperture comprises a plurality of drainage apertures.

18. The antenna of claim 16 wherein the at least one aperture comprises a plurality of apertures and wherein each of the apertures has a diameter less than one-eighth of a wavelength intended to be reflected by said reflector.

19. The antenna of claim 16 wherein the at least one aperture comprises a plurality of apertures and wherein each of the apertures has a diameter less than one-twentieth of a wavelength intended to be reflected by said reflector.

20. The antenna of claim 1 wherein the reflector is rotatable about each of two perpendicular axes.

21. The antenna of claim 20 wherein one of said axes is a vertical axis for azimuthal rotation of said reflector thereabout and wherein the other one of said axes is a horizontal axis for elevational rotation of said reflector thereabout.

22. The antenna of claim 1 further comprising a waveguide in communication with said feed.

23. The antenna of claim 22 further comprising a transducer in communication with said feed via said waveguide.

24. The antenna of claim 23 wherein said transducer comprises a radio detector.

25. The antenna of claim 23 wherein said transducer comprises a radio transmitter.

26. The antenna of claim 23 wherein said transducer comprises a radio transceiver.

27. An antenna comprising:

a) a feed configured to always point during operation in a direction that opposes ingress of water into the feed, wherein the direction is substantially vertically downward; and b) a reflector spaced apart from said feed by a focal length at least as great as a diameter of said reflector.

28. The antenna of claim 27 wherein the reflector is spaced apart from the feed by a focal length at least twice as great as the diameter of the reflector.

29. The antenna of claim 27 wherein the reflector is spaced apart from the feed by a focal length at least two-and-a-half times as great as the diameter of the reflector.

30. The antenna of claim 29 wherein a relative orientation of said reflector and said feed is adjustable.

31. The antenna of claim 27 wherein said reflector has a truncated spherical reflecting surface.

32. The antenna of claim 31 wherein the reflector is spaced apart from the feed by a focal length at least twice as great as the diameter of the reflector.

33. The antenna of claim 31 wherein the reflector is spaced apart from the feed by a focal length at least two-and-a-half times as great as the diameter of the reflector.

34. The antenna of claim 27 wherein a relative orientation of said reflector and said feed is adjustable.

35. A method comprising:

a) configuring a feed of an antenna to always point in a direction that opposes ingress of water into the feed, wherein the direction is substantially vertically downward; and b) reflecting electromagnetic radiation to or from the feed using a reflector having a truncated spherical reflecting surface.

36. A method comprising:

a) configuring a feed of an antenna to always point in a direction that opposes ingress of water into the feed, wherein the direction is substantially vertically downward; and b) reflecting electromagnetic radiation to or from the feed using a reflector spaced apart from the feed by a focal length at least as great as a diameter of the reflector.

* * * * *